US006294872B1

(12) United States Patent
Tsuruoka et al.

(10) Patent No.: US 6,294,872 B1
(45) Date of Patent: Sep. 25, 2001

(54) CATHODE RAY TUBE

(75) Inventors: Atsushi Tsuruoka; Sakae Ishii; Hisao Nakamura; Satoru Miyamoto, all of Mobara (JP)

(73) Assignees: Hitachi, Ltd., Tokyo; Hitachi Electronic Devices Co., Ltd., Mobara, both of (JP)

( * ) Notice: Subject to any disclaimer, the term of this patent is extended or adjusted under 35 U.S.C. 154(b) by 0 days.

(21) Appl. No.: 09/521,967

(22) Filed: Mar. 9, 2000

(51) Int. Cl.[7] ..... H01J 29/46

(52) U.S. Cl. ..... 315/3; 313/402; 313/409; 313/467

(58) Field of Search ..... 315/3; 313/364, 313/402, 408, 409, 415, 467, 461

(56) References Cited

U.S. PATENT DOCUMENTS

| | | | | |
|---|---|---|---|---|
| 4,672,269 | * | 6/1987 | Kamohara | 315/3 |
| 4,786,842 | * | 11/1988 | Shimoma et al. | 315/3 |
| 5,077,497 | * | 12/1991 | Kamohara et al. | 315/3 |
| 5,416,379 | * | 5/1995 | Inoue et al. | 313/402 |

FOREIGN PATENT DOCUMENTS

| | | |
|---|---|---|
| 5-258680 | 10/1993 | (JP) . |
| 6-68811 | 3/1994 | (JP) . |
| 6-251901 | 9/1994 | (JP) . |
| 9-260119 | 10/1997 | (JP) . |
| 9-298037 | 11/1997 | (JP) . |

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

A color cathode ray tube is provided with an electron gun having a voltage-dividing resistor having a stable and good voltage supplying function. The voltage-dividing resistor has an insulating substrate on which a resistor pattern and a terminal-connecting conductive film are formed, and a terminal having a first flange portion, a connecting portion, a tubular portion and a second flange portion. The first flange portion partly has a convex portion for electrical connection to the terminal-connecting conductive film, and the second flange portion is doubled. This construction provides reliable electrical connection between the terminal and the terminal-connecting conductive film.

12 Claims, 9 Drawing Sheets

CATHODE RAY TUBE

BACKGROUND OF THE INVENTION

The present invention relates to a cathode ray tube for image display and, more particularly, to a cathode ray tube having a voltage-dividing resistor provided in an electron gun housed in its neck portion.

A cathode ray tube for image display has an electron gun for emitting plural electron beams, which electron gun is housed at one end of an evacuated envelope, and a phosphor screen (screen image plane) is formed by coating the internal surface of the other end of the evacuated envelope with a plural-color phosphor layer. Many color cathode ray tubes are also provided with a color selection electrode (for example, a shadow mask) disposed in proximity to the phosphor screen. The main trend in electron guns is a so-called in-line type electron gun which emits three electron beams in parallel with one another in one plane.

FIG. 14 is a perspective view illustrating the construction of a terminal portion of a voltage-dividing resistor 50 of the type installed in an electron gun. FIG. 15 is a partial view illustrating the construction of a terminal portion of this resistor. The voltage-dividing resistor 50 has a resistor layer 22 having a predetermined resistance characteristic, the resistor layer 22 being formed on an insulating substrate 16. An insulating glass coating layer 17 is formed to cover the resistor layer 22 (or resistor pattern). A terminal 53 at one end of the voltage-dividing resistor 50 is connected to a shield cup fixed to a sixth grid electrode, a terminal 51 at the other end of the voltage-dividing resistor 50 is connected to an electrode portion held at a ground potential, and a terminal 52 provided in the middle of the voltage-dividing resistor 50 is connected to an intermediate electrode.

As shown in FIG. 15, the terminal 51 is fixed to the insulating substrate 16 in such a way that a metallic eyelet 511 is caulked to the substrate 16 in the state where the terminal 51 is inserted in a terminal-receiving hole 15, which is a through-hole provided in the substrate 16, and is maintained in contact with a terminal-connecting electrode 14. A connecting portion 51C is formed integrally with the terminal 51.

FIG. 16 is a cross-sectional view of the vicinity of the terminal 51. In the prior art built-in resistor (voltage-dividing resistor), the whole of an electrode-side flange portion 51A is maintained in contact with the terminal-connecting electrode 14 so that the terminal 51 and the terminal-connecting electrode 14 are reliably maintained in contact with each other. In addition, to reliably secure the terminal 51 to the insulating substrate 16, a substrate-side flange portion 51D is constructed so that its edge portion faces outward with respect to the terminal-receiving hole 15. A color cathode ray tube provided with this kind of voltage-dividing resistor is disclosed in, for example, Japanese Utility Model Laid-Open No. 38484/1980.

Built-in resistors for cathode ray tubes of the type which have terminals fixed to an insulating substrate by caulking are disclosed in Japanese Patent Laid-Open Nos. 258680/1993, 68811/1994, 251901/1994, 260119/1997 and 298037/1997.

The metallic eyelet formed of a hard metal material, such as stainless steel, has the problem that it cannot be caulked to a sufficient extent, so that no stable electrical contact is established between the terminal and the conductive layer. To cope with this problem, the load during caulking may be made large. However, if the caulking load is excessively large, the opening edge of the through-hole of the insulating substrate will be damaged. In addition, the related art has the problem that the built-in resistor uses a large number of components and needs a complicated component management and manufacturing process.

BRIEF SUMMARY OF THE INVENTION

The invention solves the problems of the above-described related art and provides a color cathode ray tube having an electron gun provided with a voltage-dividing resistor having, a stable and good voltage supplying function.

According to the invention, an eyelet made of metal which constitutes a terminal for a voltage-dividing resistor has a flange portion having a surface on which a convex portion is formed, the surface being disposed on a side where the flange portion makes contact with a conductive film, and reliable electrical contact is established between the terminal and the conductive film formed on a substrate by the elasticity of the terminal. The end portion of the other side of the metal eyelet faces inward.

According to this construction, damage to the opening edge of a through-hole of an insulating substrate is prevented and the contact of the terminal with a terminal-connecting conductive film is improved. In addition, the difference in thermal expansion between the insulating substrate and the terminal due to a variation in temperature is absorbed by a concave portion of the flange portion, whereby the characteristics of the electrical connection are improved and the supply of a stable focus voltage is maintained, so that a highly reliable color cathode ray tube is obtained.

DETAILED DESCRIPTION OF THE INVENTION

Figure 1:
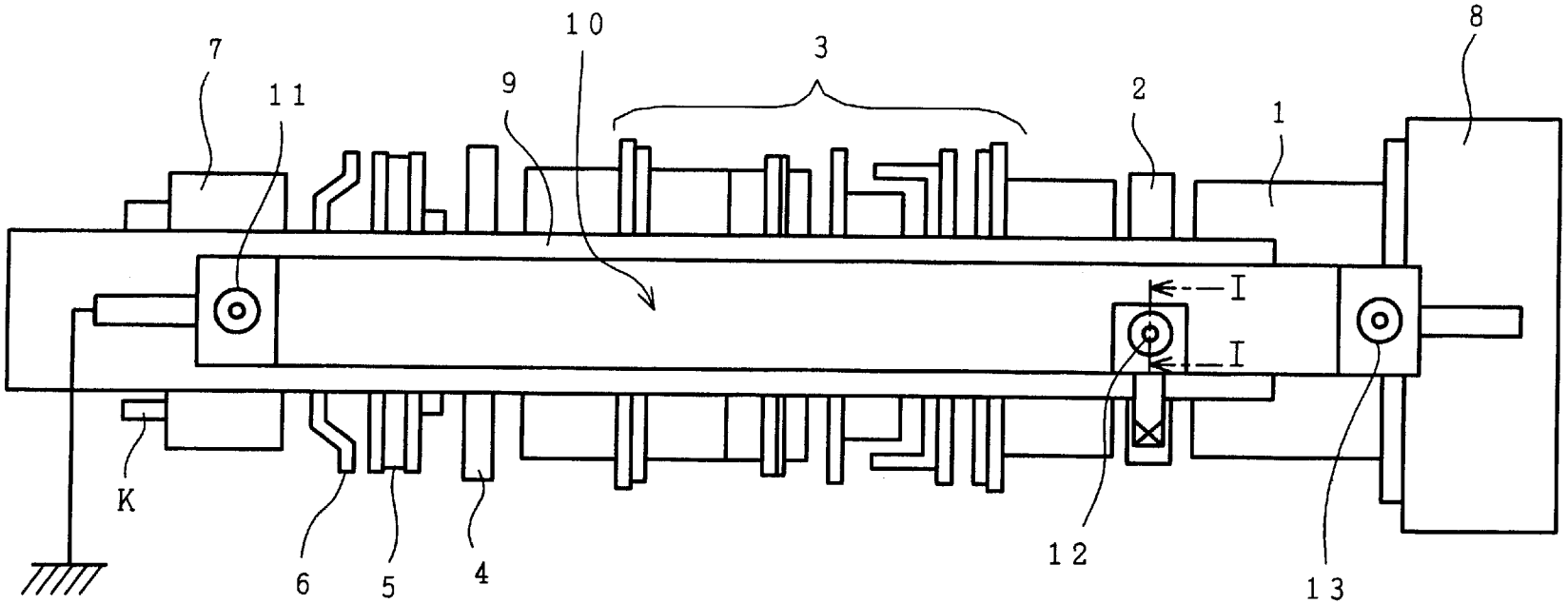
FIG. 1 is a top plan view of an electron gun for a cathode ray tube according to the invention.

Representative constructions of the invention will be described below.

(1) A color cathode ray tube houses an electron beam generating part, a focus accelerating part which focuses and accelerates an electron beam toward a phosphor screen, an insulating support rod to which plural electrodes which constitute the electron beam generating part and the focus accelerating part are fixed so as to be disposed in a predetermined order at predetermined intervals, and an electron gun having a voltage-dividing resistor secured to the insulating support rod for supplying required voltages having different potential differences to the plural electrodes which constitute the focus accelerating part.

The voltage-dividing resistor has a resistor pattern formed on a surface of an insulating substrate, terminal-connecting conductive films formed on the opposite end portions and an intermediate portion of the resistor pattern, and metal-made eyelets each of which is made of a disk-shaped flange portion and a tubular portion and serves as an external lead-out terminal. The disk-shaped flange portion has a connecting portion formed integrally with its periphery and one or plural slits formed in the periphery, and the tubular portion is located in the center of a concave portion of the flange portion.

The tubular portion of each of the metal-made eyelets is inserted through and caulked at a through-hole formed to extend through the corresponding one of the terminal-connecting conductive film and the insulating substrate, thereby bringing the flange portion of the metal-made eyelet and the corresponding terminal-connecting conductive film into surface contact with each other.

(2) A cathode ray tube includes a phosphor screen, a shadow mask which acts as a color selection electrode, and an electron gun which generates three electron beams arrayed in line, the electron gun being disposed in a neck portion. The cathode ray tube comprises a resistor device having a resistor formed on an insulating substrate, the resistor device being disposed in the neck portion and the resistor having a connecting electrode, the connecting electrode being electrically connected to the electron gun via a terminal made of metal. The terminal has a first flange portion, a connecting portion, a tubular portion and a second flange portion, and electrical conduction of the terminal to the resistor is established by caulking the resistor between the first flange portion and the second flange portion. At least part of the first flange portion is bent toward an upper portion of the tubular portion to form a convex portion, and the convex portion is electrically connected to the resistor. The second flange portion is doubled.

(3) A cathode ray tube includes a panel portion having a phosphor layer formed on its internal surface, a neck portion, and a funnel portion which connects the panel portion and the neck portion, the neck portion containing an electron gun which generates electron beams and emits the electron beams toward the phosphor layer. The electron gun is provided with a resistor device having a resistor formed on an insulating substrate, and the resistor has a connecting electrode and the connecting electrode is electrically connected to the electron gun via a terminal made of metal. The terminal is inserted in a through-hole formed in the resistor device and has a first flange portion, a tubular portion having an opening and a second flange portion. The terminal is fixed to the resistor device by caulking the resistor device between the first flange portion and the second flange portion. The second flange portion is crimped back and an end portion of the terminal which is positioned in the second flange portion faces toward a center of the through-hole.

Preferred embodiments of the invention will be described below with reference to the accompanying drawings.

FIG. 1 is a side view of an in-line type electron gun provided with a voltage-dividing resistor, as viewed in a direction perpendicular to the in-line direction of the electron gun. The electron gun is made up of an anode (the sixth grid electrode) 1 to which a maximum voltage (anode voltage) is to be applied, an intermediate grid electrode 2 to which a voltage divided by a voltage-dividing resistor is to be supplied, a fifth grid electrode group 3 made up of plural electrodes which constitute a main lens for focusing an electron beam emitted from a cathode K, a fourth grid electrode 4, a third grid electrode 5, a second grid electrode 6 and a first grid electrode 7.

The electrodes 1 to 7 are fixed in such a manner as to be disposed at predetermined intervals in a predetermined order with the peripheral portion of each of them being partly buried in a pair of insulating support rods (bead glasses) 9. A shield cup 8 is secured to the sixth grid electrode 1.

A voltage-dividing resistor 10 is secured to one of the insulating support rods 9 which support the electrodes 1 to 7 of the electron gun. This voltage-dividing resistor 10 has connecting external lead-out terminals (hereinafter referred to simply as the terminals) 11, 12 and 13. The terminal 13 is connected to a side wall of the shield cup 8 to which an anode voltage is to be applied, the terminal 12 is connected to the intermediate grid electrode 2, and the terminal 11 is connected to ground.

Figure 2:
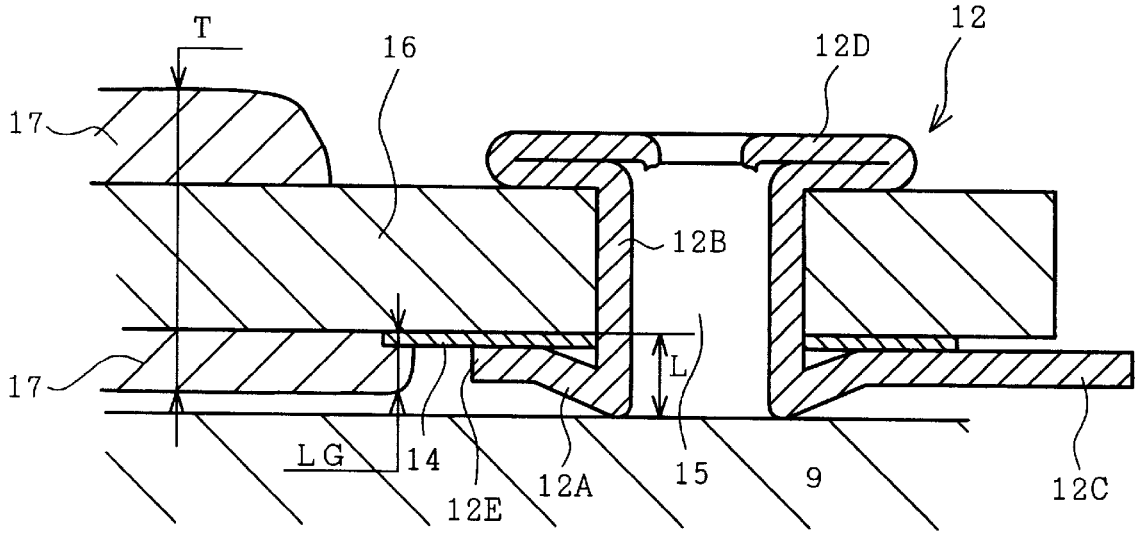
FIG. 2 is a cross-sectional view taken along line I—I of FIG. 1.

FIG. 2 is a cross-sectional view taken along line I—I of FIG. 1, showing the metal-made terminal 12. In FIG. 2, reference numeral 12A denotes a first flange portion, reference numeral 12B denotes a tubular portion, reference numeral 12C denotes a connecting portion, reference numeral 12D denotes a second flange portion, reference numeral 14 denotes a terminal-connecting electrode, reference numeral 15 denotes a terminal-receiving hole formed to extend through an insulating substrate 16, and reference numeral 17 denotes an insulation film.

The terminal 12 has a first flange portion 12A and a connecting portion 12C on one side of the substrate 16. The first flange portion 12A is brought into contact with the terminal-connecting electrode 14 formed on the insulating substrate 16 (hereinafter referred to simply as the connecting electrode 14), thereby establishing electrical conduction. This connecting electrode 14 is formed of a conductive film. A convex portion is formed on the surface of the first flange portion 12A that is brought into contact with the connecting electrode 14. By bringing this convex portion into contact with the connecting electrode 14, stable contact can be obtained owing to the elastic action of the terminal 12. The edge portion of the first flange portion 12A faces outward with respect to the terminal-receiving hole 15.

The terminal 12 has a second flange portion 12D on the other side of the substrate 16. The second flange portion 12D is crimped back halfway to form a double structure. That is to say, the edge portion of the second flange portion 12D faces toward the center of the terminal-receiving hole 15. Because the second flange portion 12D has a double structure, the terminal 12 can be reliably fixed. In addition, the terminal 12 is fixed by the resistor being clamped between the first flange portion 12A and the second flange portion 12D. Accordingly, stable electrical contact is ensured for a long time and a divided voltage can be reliably supplied to a focus electrode, whereby it is possible to provide a highly reliable color cathode ray tube.

The terminal 12 has a tubular portion 12B extending between the first flange portion 12A and the second flange portion 12D. The second flange portion 12D is formed by crimping part of the tubular portion 12B. The thickness of the second flange portion 12D of the terminal 12 is smaller than that of the insulation film 17. Therefore, the terminal 12 can be prevented from coming into contact with other electron gun components.

The height L of the terminal 12 on the side of the insulating support rod 9 is larger than the height LG of the insulation film 17 on the same side (the height LG<the height L). Therefore, when the terminal 12 and the insulating support rod 9 are brought into contact with each other, the insulation film 17 and the insulating support rod 9 do not make contact with each other. In this embodiment, the height L of the terminal 12 on the side of the support rod 9 is 0.2 mm, the height LG of the insulation film 17 on the side of the support rod 9 is 0.13 mm, a thickness LT of the terminal 12 on the side of the support rod 9 is 0.13 mm, and a thickness T equivalent to the total of the thicknesses of both insulation films 17 and the insulating substrate 16 is 1.17 mm. Because a clearance is provided between the insulation film 17 and the support rod 9, the breakdown voltage characteristic between the insulation film 17 and the support rod 9 is improved.

In a knocking step, about 60 kV which is about twice the normal voltage is applied to the anode electrode, and the electrodes other than the anode electrode and the intermediate electrode are grounded. When such a high voltage is applied to the anode electrode, the discharge between the insulation film 17 and the insulating support rod 9 can be prevented, whereby damage to the insulation film 17 can be prevented. Moreover, because the terminal 12 has no contact with the insulation film 17, damage to a portion of the insulation film 17 that is near the terminal 12 can be prevented.

In addition, the height of the terminal 11 on the side of the insulating support rod 9 is made larger than the height LG of the insulation film 17 on the side of the support rod 9, whereby the portion of contact between the support rod 9 and the insulation film 17 can be eliminated. Since the support rod 9 and the insulation film 17 have no contact with each other, damage to the voltage-dividing resistor 10 can be prevented. In addition, since the knocking voltage to be applied to the anode electrode can be made sufficiently high, foreign matter which adheres to the electron gun can be removed. Accordingly, it is possible to obtain a cathode-ray tube which displays a far better image.

Figure 3:
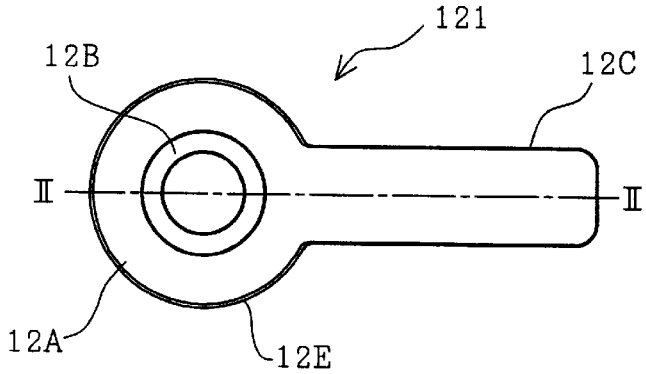
FIG. 3 is a top plan view of a metal-made eyelet which constitutes a terminal of a voltage-dividing resistor.
Figure 4:
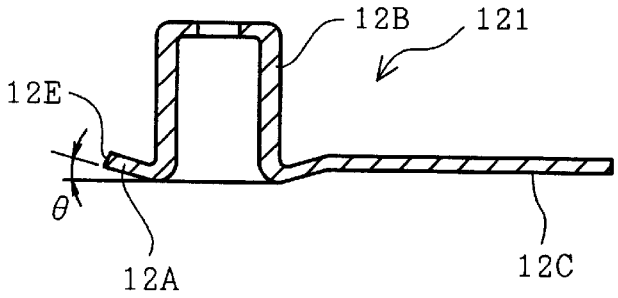
FIG. 4 is a cross-sectional view taken along line II—II of FIG. 3.

FIG. 3 is a plan view of a metallic eyelet 121 which is not yet formed into the terminal 12 of FIG. 2. FIG. 4 is a cross-sectional view taken along line II—II of FIG. 3. The metallic eyelet 121 which constitutes the terminal 12 has a disk-shaped first flange portion 12A having a periphery formed integrally with the connecting portion 12C. The metallic eyelet 121 also has the tubular portion 12B which extends from the concave central part of the first flange portion 12A.

A convex portion is formed on the surface of the first flange portion 12A which comes into contact with connecting electrode 14. By bringing this convex portion into contact with the connecting electrode 14, stable contact can be obtained owing to the elastic action of the terminal 12. The bending angle e of the first flange portion 12A is desirably larger than 0° and smaller than 45°, preferably, between 5° and 20°.

In the metallic eyelet 121, an end portion 12F opposite to the first flange portion 12A (the upper end of the tubular portion 12B) faces inward with respect to the tubular portion 12B. That is to say, the end portion 12F faces toward the center of the terminal-receiving hole 15. The first flange portion 12A and the end portion 12F of the terminal 12 differ from each other in inner diameter.

Figure 5:
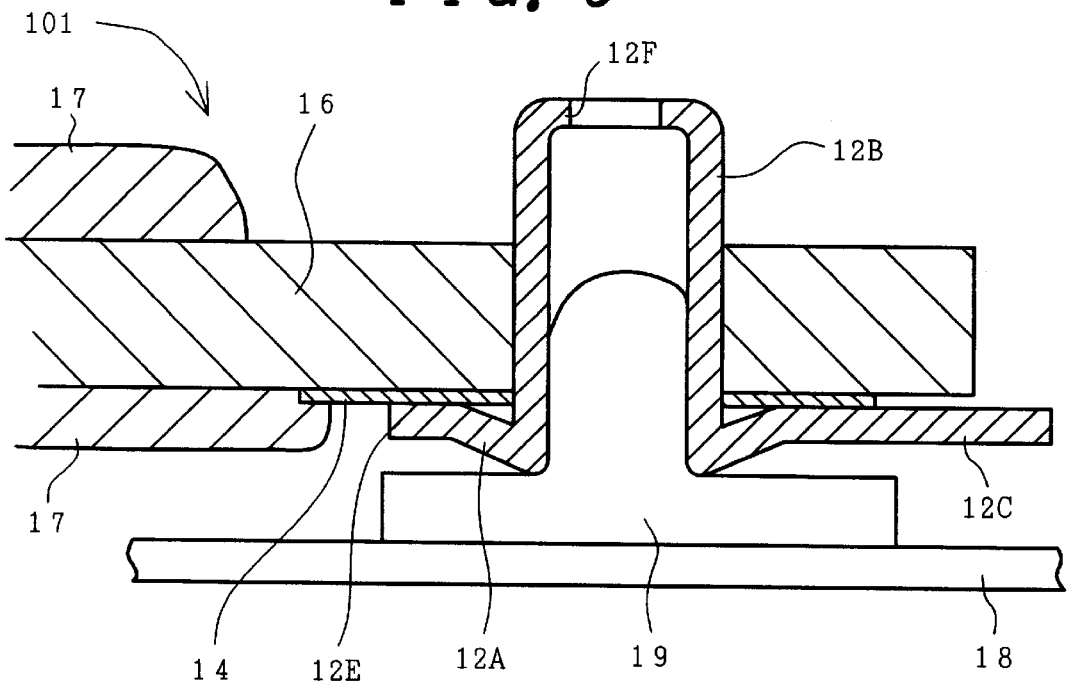
FIGS. 5, 6 and 7 are sectional views illustrating sequential steps of a caulking process for caulking the metallic eyelet which constitutes the terminal.
Figure 6:
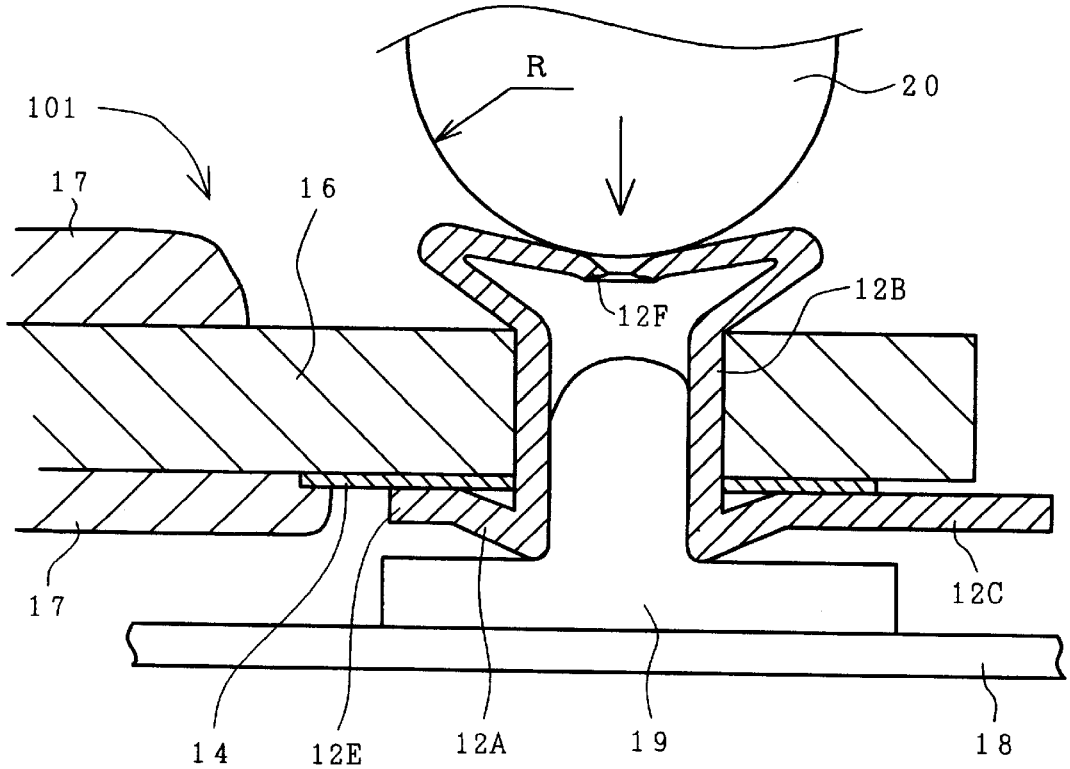
Figure 7:
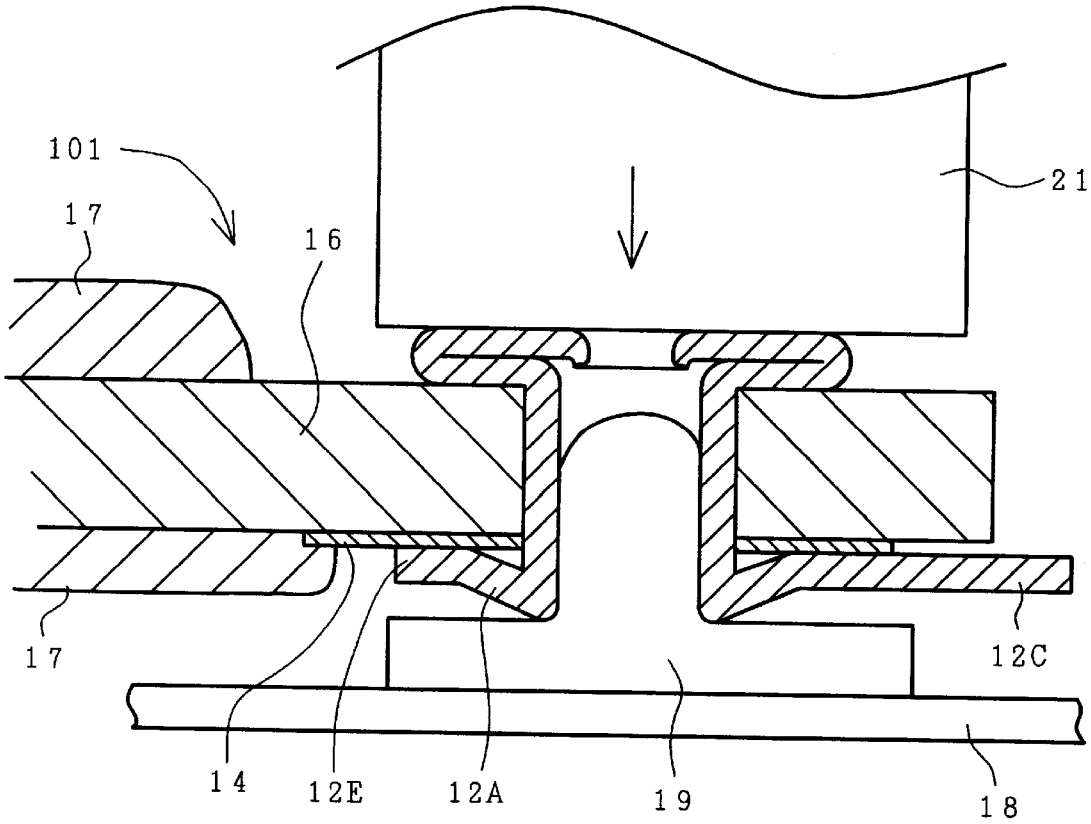

FIGS. 5 to 7 show sequential steps in the process of forming the terminal according to the invention. Reference numeral 18 denotes a caulking table. This caulking table 18 is provided with an axial centering die 19 onto which the tubular portion 12B of the metallic eyelet 121 is fitted.

FIG. 5 shows the state in which the metallic eyelet 121 and a resistance substrate 101 are set on the caulking table 18. The resistance substrate 101 has a resistor, the connecting electrode 14 and the terminal-receiving hole 15 formed on the insulating substrate 16 made of alumina. The resistor and part of the connecting electrode 14 are covered with glass 17 (for example, borosilicate lead glass). During a crimping process (hereinafter referred to as the caulking process), the tubular portion 12B is inserted into the terminal-receiving hole 15 which is formed to extend through the insulating substrate 16, so that the flange portion 12A of the metallic eyelet 121 which constitutes the terminal 12 is brought into contact with the connecting electrode 14. At this time, the end portion of the tubular portion 12B projects from the insulating substrate 16 on the opposite side thereof.

The caulking process is performed in two steps.

FIG. 6 is a view illustrating the first step of the caulking process. In the first step of the caulking process, a caulking tool 20 having a spherical portion to be pressed into contact with the, metallic eyelet 121 (hereinafter referred to as the spherical punch 20) is used. The top portion of the tubular portion 12B is loaded by the spherical punch 20. In this process, the top portion of the tubular portion 12B is deformed. Because the tip of the spherical punch 20 has a spherical surface having a radius of curvature R, the top portion of the tubular portion 12B is deformed so that its intermediate portion becomes convex outward with respect to the terminal-receiving hole 15. On the other hand, the end portion 12F of the tubular portion 12B still faces toward the center of the terminal-receiving hole 15. In this embodiment, since the tubular portion 12B of the metallic eyelet 121 has a tubular shape, a spherical punch is used, but the spherical punch 20 needs only to have a radius of curvature adapted to the shape of the tubular portion 12B.

FIG. 7 is a view illustrating the second step of the caulking process. Reference numeral 21 denotes a caulking tool for use in the second step of the caulking process. The caulking tool 21 has a flat portion to be pressed into contact with the metallic eyelet 121. After the spherical punch has been used, the flat caulking tool (flat punch) 21 shown in FIG. 7 is used to deform the top portion of the tubular portion 12B to a further extent, thereby forming the terminal 12.

Through the above-described process, the terminal 12 shown in FIG. 2 can be obtained. The end portion 12F of the tubular portion 12B of the deformed eyelet 121 (i.e., the end portion of the eyelet 121) faces toward the terminal-receiving hole 15 and forms the second flange portion 12D having a double structure. At this time, a convex portion 12E of the first flange portion 12A is brought into contact with the connecting electrode 14.

The shape of the tubular portion 12B of the eyelet 121 is not limited to a tubular shape, and may also be a quadrangular prism. In the resistor having the terminal 12 formed by the above-described two caulking steps, no minute cutouts occur. Since the caulking process is performed in plural steps, the load per caulking step can be made small.

Figure 8:
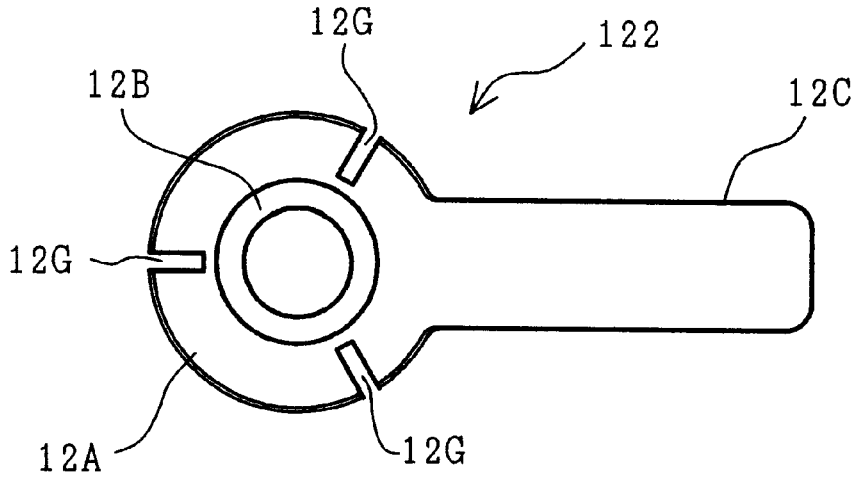
FIG. 8 is a top plan view of another embodiment of the metal-made eyelet which constitutes the terminal of the voltage-dividing resistor.

FIG. 8 shows another metallic eyelet 122 according to another embodiment. Plural slits 12G are formed in the periphery of the flange portion 12A, and the connecting portion 12C is formed integrally with part of the periphery. These plural slits 12G are formed at positions symmetrical with respect to the longitudinal central axis of the connecting portion 12C.

The tubular portion 12B of the metallic eyelet 122 is inserted through the through-hole provided in the substrate 16 and the connecting electrode 14 of the voltage-dividing resistor and is formed by a caulking process in a manner similar to that described above with reference to FIGS. 5 to 7. The first flange portion 12A of the terminal 12 formed by the metallic eyelet 122 has an angle θ. Owing to the angle θ, the connecting electrode 14 and the terminal 12 are brought into reliable contact with each other. In addition, at this time, the presence of the plural slits 12G makes it possible to obtain sufficient contact between the flange portion 12A and the terminal-connecting conductive film without increasing the caulking load. That is to say, the formation of the slits 12G makes it possible to adjust the elastic strength of the first flange portion 12A, whereby it is possible to obtain a stable contact.

The slits are formed in the flange portion of the metallic eyelet which constitutes the terminal of the voltage-dividing resistor, so that the caulking load can be made small. In this construction, no thermal treatment is needed and the caulking load of the flange portion of the metallic eyelet is small so that the breakage of the opening edge of the through-hole of the substrate is prevented and the contact of the flange portion with the terminal-connecting conductive film is improved. Accordingly, by using an electron gun provided with a voltage-dividing resistor having this terminal construction, it is possible to obtain a color cathode ray tube having far higher reliability.

Figure 9:
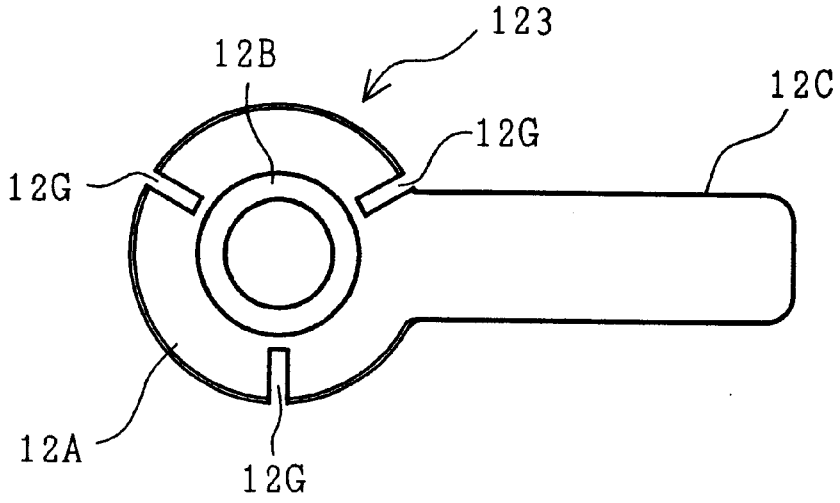
FIG. 9 is a top plan view of another embodiment of the metal-made eyelet which constitutes the terminal of the voltage-dividing resistor.

FIG. 9 shows another metallic eyelet 123 according to another embodiment. In this construction, the slits 12G are formed at positions asymmetrical with respect to the longitudinal central axis of the connecting portion 12C. This construction makes it possible to increase the efficiency of punching in the manufacture of eyelets.

The positions of the slits 12G formed in the flange portion 12A are not specifically limited. The number of the slits 12G should be at least one, but in terms of the balance of the caulking load and connection strength, it is preferable to form the slits 12G at three positions, as in the case of each of the embodiments. Accordingly, stable electrical contact is ensured for a long time and a divided voltage can be reliably supplied to a focus electrode, whereby it is possible to provide a highly reliable color cathode ray tube.

Figure 10:
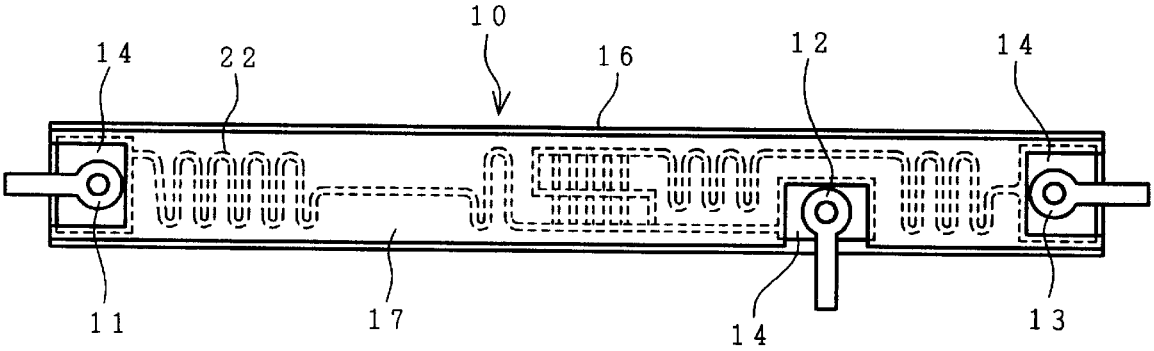
FIG. 10 is a plan view of the voltage-dividing resistor.

FIG. 10 is a plan view illustrating an actual example of the shape of the voltage-dividing resistor 10 for use in a color cathode ray, tube according to the invention. As shown, the resistor pattern 22 is formed as a bent and crimped-back pattern to obtain the required voltage value in a limited surface of the insulating substrate 16. By using the voltage-dividing resistor 10, the characteristics of electrical connection are improved and the supply of a stable focus voltage is maintained, whereby a Highly reliable color cathode ray tube can be obtained.

Figure 11:
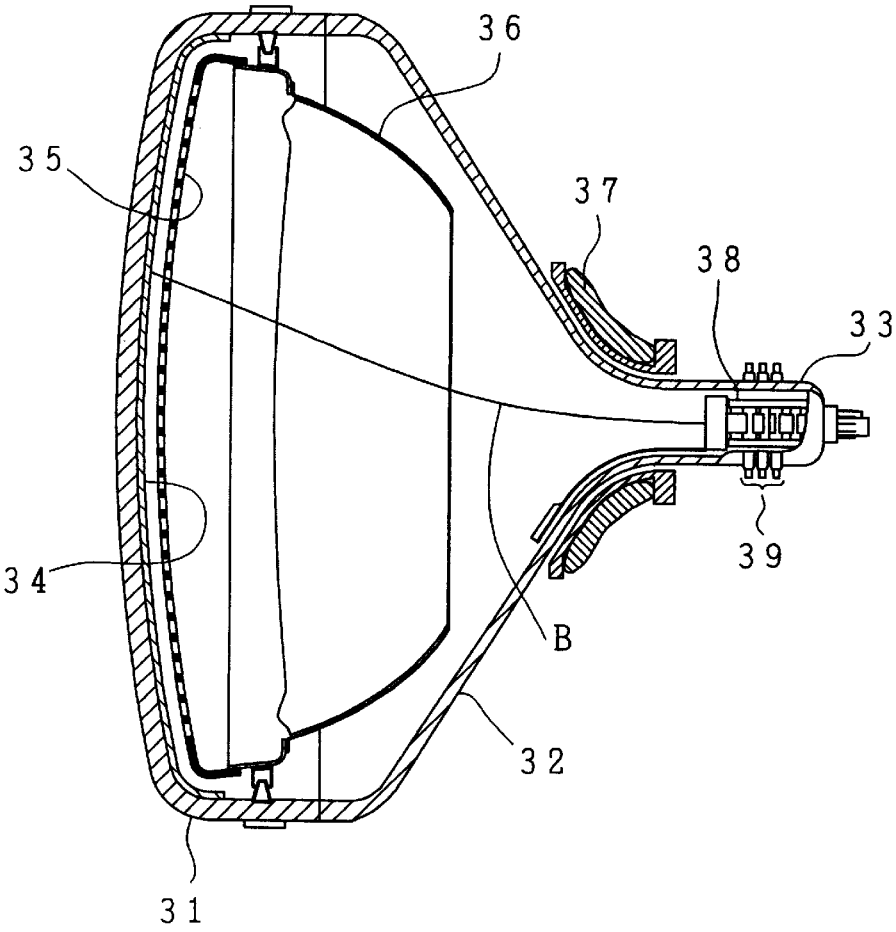
FIG. 11 is a cross-sectional view of a color cathode ray tube according to the invention.
Figure 12:
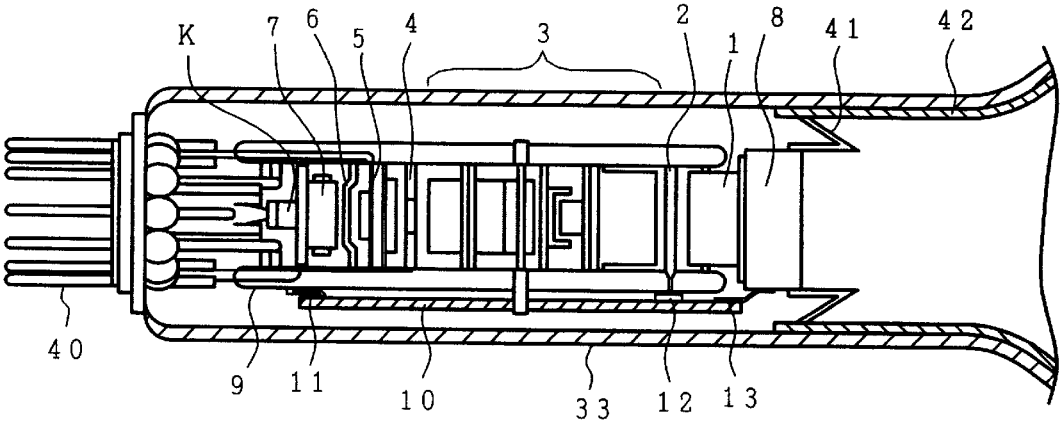
FIG. 12 is a side view of the neck portion of a color cathode ray tube which houses an in-line type electron gun provided with a voltage-dividing resistor.

FIG. 11 is a side view of the essential portion of a color cathode ray tube, and FIG. 12 is a side view of the electron gun shown in FIG. 11, as viewed in the in-line direction thereof.

FIG. 11 is a diagrammatic cross-sectional view illustrating the construction of a cathode ray tube to which the present invention is applied. The cathode ray tube comprises a panel portion 31, a neck portion 33, a funnel portion 32 which connects the panel portion 31 and the neck portion 33, a phosphor screen 34 which is formed on the internal surface of the panel portion 31 and constitutes an image display screen, a shadow mask 35 which operates as a color selection electrode, an inner shield 36 which blocks external magnetism, a deflection yoke 37 which is disposed in the funnel portion 32 and deflects electron beams horizontally and vertically, an electron gun 38 which is housed in the neck portion 33 and emits three electron beams B in one horizontal plane (in-line), and a magnetic device 39 for controlling color purity and effecting centering corrections.

In the construction shown in FIG. 11, the panel portion 31, the neck portion 33 and the funnel portion 32 constitute an evacuated envelope, and the electron beams B emitted from the electron gun 38 are two-dimensionally scanned on the phosphor screen 34 by being deflected in horizontal and vertical directions by a deflection magnetic field formed by the deflection yoke 37.

FIG. 12 is a cross-sectional view of the state in which the electron gun shown in FIG. 1 is housed in the neck portion 33 of the evacuated envelope of the color cathode ray tube. Reference numeral 40 denotes stem pins for supplying the required signals to the respective electrodes of the electron gun. One end of a contact spring 41 is welded to the side surface of the front portion of the shield cup 8.

The inner wall of the evacuated envelope is coated with an interior conductive film 42 of graphite or the like, and the interior conductive film 42 extends into part of the neck portion 33 so that an anode voltage (maximum voltage) introduced from an anode button (not shown) provided in the funnel portion 33 is supplied to the electron gun The other end of the contact spring 41 is maintained in elastic contact with the interior conductive film 42 to supply the anode voltage to the sixth grid electrode 1.

A connecting portion 13C which extends from a terminal 13 is welded to the side surface of the shield cup 8. The connecting portion 12C is extended from the terminal 12 and welded to the intermediate grid electrode 2 so that a high voltage obtained by dividing the anode voltage by a resistance ratio is supplied to the intermediate grid electrode 2. The terminal 11 is connected to a metal part buried in the insulating support rod 9, via a connecting portion 11C. The metal part is connected to one of the stem pins 40, and is connected to a potential (ground potential) such as ground through the stem pins 40 outside the cathode ray tube.

Incidentally, the invention is not limited to any of the above-described constructions, and various modifications can be made without departing from the scope and spirit of the invention. The invention is not limited to a color cathode ray tube provided with an electron gun which emits plural electron beams, and can similarly be applied to a projection type cathode ray tube which emits a single electron beam, and various other cathode ray tubes provided with electron guns having voltage-dividing resistors.

Figure 13:
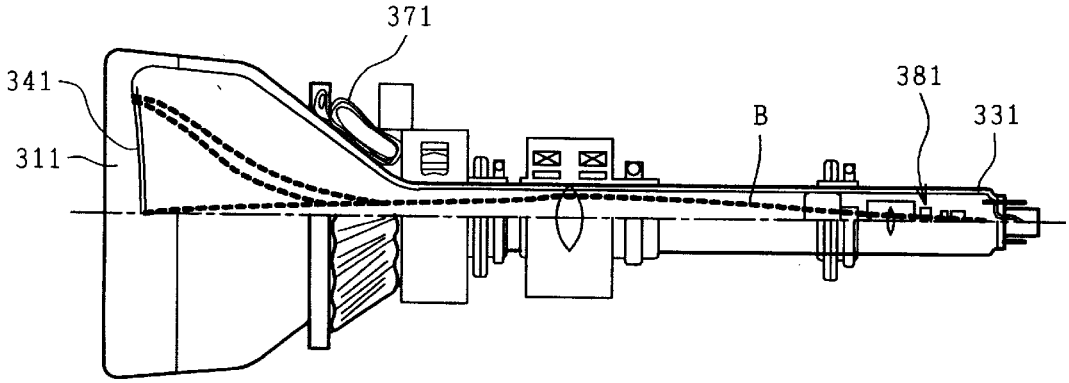
FIG. 13 is a partial cross-sectional view of a projection type cathode ray tube according to the invention.
Figure 14:
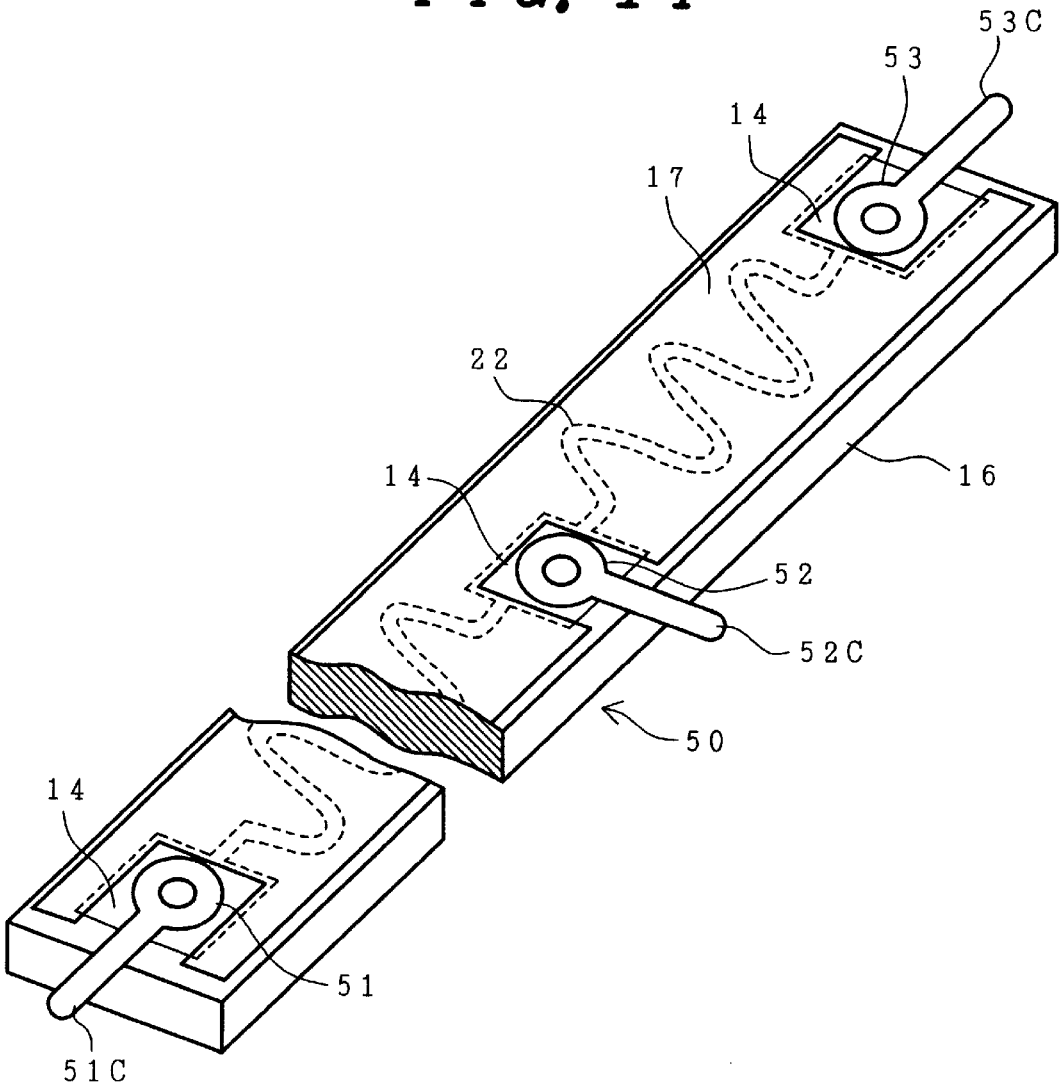
FIG. 14 is a perspective view illustrating the construction of terminal portions of the voltage-dividing resistor.
Figure 15:
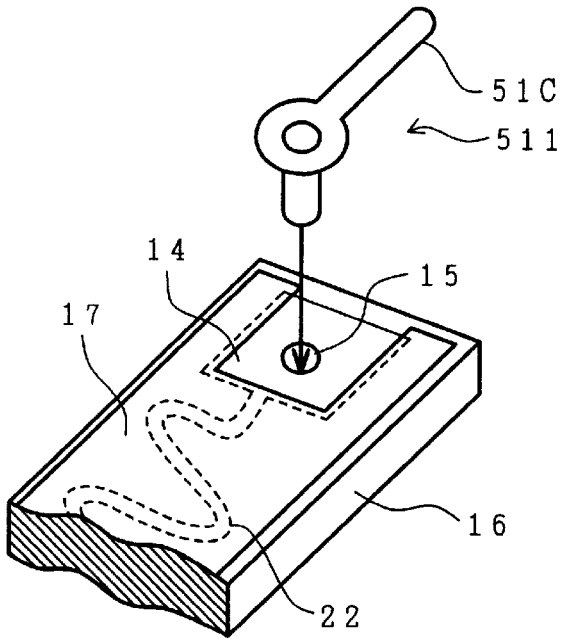
FIG. 15 is a partial view illustrating the construction of a terminal portion.
Figure 16:
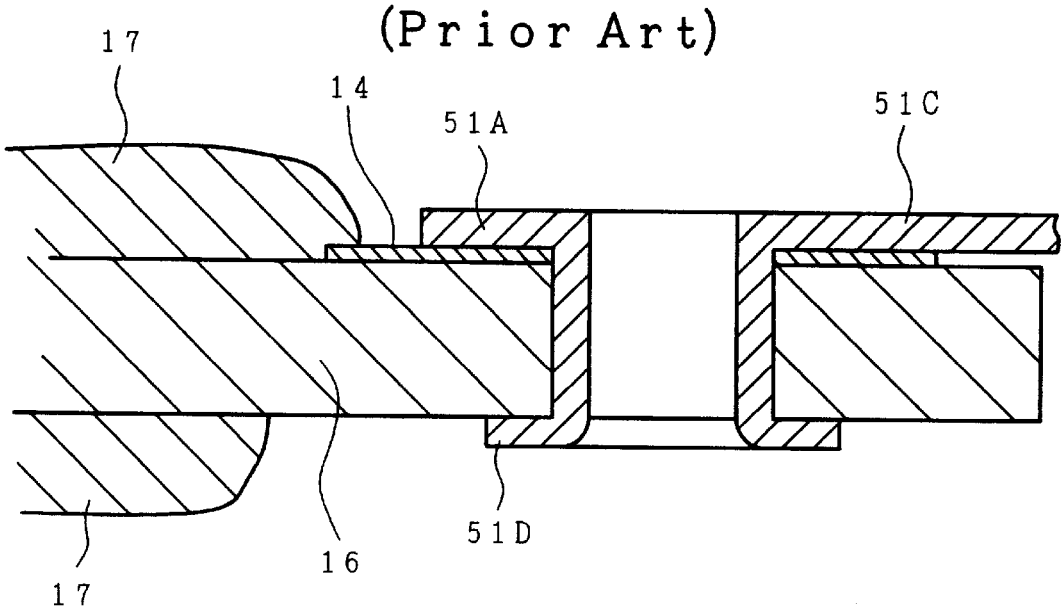
FIG. 16 (Prior Art)
FIG. 16 is a cross-sectional view illustrating the construction of a related art terminal portion.

FIG. 13 is a view showing one embodiment of a projection type cathode ray tube. The upper side of FIG. 13 is a cross-sectional view of the upper half of the essential portion of the projection type cathode ray tube, while the lower side of FIG. 13 is a side view of the lower half of the essential portion of the same. The invention can also be applied to a built-in resistor for use in a cathode ray tube having one electron gun. Projection type cathode ray tubes are widely used in so-called video projectors. In general, a video projector is disposed at a position spaced a predetermined distance from a projecting screen and projects a reproduced image from the faceplate panel surface of a projection type cathode ray tube onto the projecting screen to display a magnified projected image of the reproduced image.

In FIG. 13, an electron gun 381 which irradiates, controls, accelerates and focuses the electron beams B is housed in a neck portion 331 of a glass bulb. A single-color phosphor screen 341 is formed by deposition on the internal surface of the panel portion 311, thereby constituting the projection type cathode ray tube. In addition, a deflection yoke 371 for deflecting the electron beams B emitted from the electron gun 381 is secured to the periphery of the funnel portion of the glass bulb, and the phosphor screen 341 is made to luminesce.

Although the above description of each of the embodiments has referred to the terminal 12, the terminals 11 and 13 may also be constructed in a similar manner. Although each of the above-described embodiments uses three terminals, the number of terminals is not limited to three.

As is apparent from the foregoing description, according to the present invention, since slits are provided in the flange portion of a metallic eyelet which constitutes a terminal for a voltage-dividing resistor, sufficient surface contact can be obtained between the flange portion and a terminal-connecting conductive film by a small caulking load and a positional deviation due to a variation in operating temperature decreases, whereby the characteristics of electrical connection are improved and the supply of a stable focus voltage is maintained for a long time. Accordingly, it is possible to provide a highly reliable color cathode ray tube.

What is claimed is:

1. A cathode ray tube including a phosphor screen, a shadow mask which acts as a color selection electrode, and an electron gun which generates three electron beams arrayed in line, the electron gun being disposed in a neck portion, comprising:

a resistor device having a resistor formed on an insulating substrate, the resistor device being disposed in the neck portion and the resistor having a connecting electrode, the connecting electrode being electrically connected to the electron gun via a terminal made of metal;

the terminal having a first flange portion, a connecting portion, a tubular portion and a second flange portion, electrical conduction of the terminal to the resistor being established by caulking the resistor between the first flange portion and the second flange portion, at least part of the first flange portion being bent toward an upper portion of the tubular portion to form a convex portion, the convex portion being electrically connected to the resistor, the second flange portion being doubled.

2. The cathode ray tube according to claim 1, wherein the first flange portion is bent near a portion where the first flange portion meets the tubular portion, and an end portion of the first flange portion electrically conducts to the connecting electrode.

3. The cathode ray tube according to claim 2, wherein a bending angle of the first flange portion is larger than 0° and smaller than 45° with respect to a substrate surface of the connecting electrode.

4. The cathode ray tube according to claim 3, wherein the bending angle of the first flange portion is in range of 5°–20° with respect to a substrate surface of the connecting electrode.

5. A cathode ray tube including a panel portion having a phosphor layer formed on its internal surface, a neck portion, and a funnel portion which connects the panel portion and the neck portion, the neck portion containing an electron gun which generates electron beams and emits the electron beams toward the phosphor layer, comprising:

a resistor device having a resistor formed on an insulating substrate, the resistor device being provided in the electron gun and the resistor having a connecting electrode, the connecting electrode being electrically connected to the electron gun via a terminal made of metal;

the terminal being inserted in a through-hole formed in the resistor device and having a first flange portion, a tubular portion having an opening and a second flange portion, the terminal being fixed to the resistor device by caulking the resistor device between the first flange portion and the second flange portion, the second flange portion being crimped back and an end portion of the terminal which is positioned in the second flange portion facing toward a center of the through-hole.

6. The cathode ray tube according to claim 5, wherein an internal diameter of the opening of the terminal on the side of the second flange portion is smaller than an internal diameter of the opening of the terminal on the side of the first flange portion.

7. The cathode ray tube according to claim 5, wherein the end portion of the terminal which is positioned in the second flange portion is positioned on a central side of the through-hole with respect to the tubular portion.

8. The cathode ray tube according to claim 5, wherein the electron gun emits a single-color electron beam and the phosphor screen is formed of a single-color phosphor.

9. The cathode ray tube according to claim 5, wherein the electron gun emits three electron beams arrayed in line and the phosphor screen is formed of a three-color phosphor layer.

10. The cathode ray tube according to claim 5, wherein the first flange portion is bent near a portion where the first flange portion meets the tubular portion, and an end portion of the first flange portion electrically conducts to the connecting electrode.

11. The cathode ray tube according to claim 5, wherein a bending angle of the first flange portion is larger than 0° and smaller than 45° with respect to a substrate surface of the connecting electrode.

12. The cathode ray tube according to claim 5, wherein the bending angle of the first flange portion is in range of 5°–20° with respect to a substrate surface of the connecting electrode.

* * * * *